US006222451B1

(12) United States Patent
Leow

(10) Patent No.: US 6,222,451 B1
(45) Date of Patent: Apr. 24, 2001

(54) DELIVERY SIGNAL DEVICE FOR A MAILBOX

(75) Inventor: Von Let Leow, Ipoh (MY)

(73) Assignee: Reka Cipta Innovasi SDN BHD, Perak Darul Ridzuan (MY)

( * ) Notice: Subject to any disclaimer, the term of this patent is extended or adjusted under 35 U.S.C. 154(b) by 0 days.

(21) Appl. No.: 09/624,928

(22) Filed: Jul. 25, 2000

(30) Foreign Application Priority Data

Dec. 2, 1999 (MY) ..... PI 990 5243

(51) Int. Cl.[7] ..... G08B 13/14
(52) U.S. Cl. ..... 340/569; 340/691.1; 362/155
(58) Field of Search ..... 340/569, 666, 340/691.1; 362/155

(56) References Cited

U.S. PATENT DOCUMENTS 3,909,819 * 9/1975 Radford ..... 340/281
4,101,877 * 7/1978 Rush ..... 340/569
4,520,350 * 5/1985 Huang ..... 340/569
4,651,135 * 3/1987 Duhaime et al. ..... 340/569
4,999,612 * 3/1991 Cherveny ..... 340/569
5,917,411 * 6/1998 Baggarly ..... 340/569
6,033,084 * 3/2000 Burke ..... 362/155
6,114,959 * 9/2000 Bennett ..... 340/569

* cited by examiner

*Primary Examiner*—Jeffery Hofsass
*Assistant Examiner*—Phung T Nguyen
(74) *Attorney, Agent, or Firm*—Merchant & Gould P.C.

(57) ABSTRACT

The invention discloses a delivery signal device for a mailbox. It comprises a catcher means (11) connected to the effort arm of a lever (15) which operates a magnetic switch (14). The magnetic switch (14) operates an electrical circuit (19) which then activates a warning system. In one embodiment as taught by the invention, the warning system employs a flashing LED light (30) and this is achieved with the assistance of an integrated electrical circuit (19). The size of the catcher means (11) can be flexibly designed to fit that of a mailbox. To provide equilibrium to the lever (15), a counter weight (13) is provided on the load arm of the lever (15) opposite the catcher means (11). The underside of the load arm of the lever (15) is further provided with a magnet means **(14*a*) operating a normally closed reed switch (14*b*)**.

10 Claims, 10 Drawing Sheets

DELIVERY SIGNAL DEVICE FOR A MAILBOX

TECHNICAL FIELD

The invention relates generally to a delivery signal device for a mailbox or the like, and particularly to one with a lever inside the mailbox which activates an audio or visual alarm or a combination of the two when a mail is inserted into the mailbox.

BACKGROUND

In rural area, a standing mailbox is disposed near a road which may be at a distance from a house. The mailbox may or may not be locked. In case it is lockable, the mailbox door is provided with a slot to allow insertion of the mail. The mailbox is commonly provided with an erectable arm. When a mail is inserted into the box, the postman 'flags up' the arm to indicate that there is mail in the box. When the mail is withdrawn, the arm is then 'flagged down'. This mechanical arrangement may be overlooked, particularly when the postman is not so co-operative or he is rushing for time, for an example, when it is drizzling.

In urban settings like a condominium or an office block, the mailboxes belonging to the occupants are placed at a convenient location such as the basement or the ground floor. Each mailbox belonging to each housing or office unit is invariably locked, in order to discourage unauthorized access to the mail. Each mailbox is provided with a slot to allow insertion of the mail. It is also common to cover the slot with a tiltable cover plate to discourage peeping. The security arrangement, however, does not allow easy knowledge whether there is mail in the box or not.

The U.S. Pat. No. 3,909,819 discloses a mailbox alarm apparatus comprising an enclosed mailbox having an openable door; and photosensitive means for initiating activation of an alarm signal in response to light coming from outside the mailbox when the door is opened. The main disadvantage of this teaching is that the door has to be opened before the alarm is being activated. In normal situation, the mailbox is locked and a slot is provided on the door to allow mail to be inserted. The door is invariably locked, to discourage unauthorized access.

The U.S. Pat. No. 4,101,877 discloses a mail delivery alarm system for activating at least one signal device located in a house when mail is deposited in a mailbox located outside the house, and for deactivating the signal device when the mail is withdrawn from the mailbox. A switch means is provided inside the mailbox and a circuit is arranged to activate the signal devices every other time the switch means is closed. An electrically engageable lock means is located in said mailbox for keeping the mailbox door shut, said lock being engaged every other time said switch means is closed, and the switch means can be manually operated for disengaging said lock means. The main disadvantage of this teaching is that the signal device is dependent on the switch means which is largely dependent on a counter device.

SUMMARY OF THE INVENTION

The primary object of the invention is to provide an easy and simple to install delivery signal device for a mailbox, whether in rural or urban setting.

The secondary object of the invention is that the device could be made available to the public at large as a separate gadget or integrally built-in to a mailbox.

Another object of the invention is that the delivery signal device generates an audio or visual signal or a combination of the two continuously when there is mail in the box, until it is withdrawn.

Yet, another object of the invention is that the delivery signal device is driven by a self-contained power source which should last for a long time, without constant replacement, and with easy maintenance.

According to the invention, a delivery signal device for a mailbox comprises a catcher means connected to the effort arm of a lever, a counter weight mounted onto the load arm of the lever; a magnetic switch consists of two components:- one is a magnet means which is mounted to the underside of the load arm of the lever, and one is a reed switch which is mounted on an integrated electrical circuit block; the magnetic switch further operating a battery-driven electrical circuit to activate a warning system; and a container to house the counter weight, the magnetic switch, the battery and the circuit.

The delivery signal device is mounted inside the mailbox, whereas the electrical circuit is activated by the magnetic switch whenever the catcher means receives a mail, and the circuit is de-activated whenever the mail is removed or the mailbox is empty.

These above objects and other objects will become apparent, following the description of the invention here below.

DETAILED DESCRIPTION

Figure 1A:
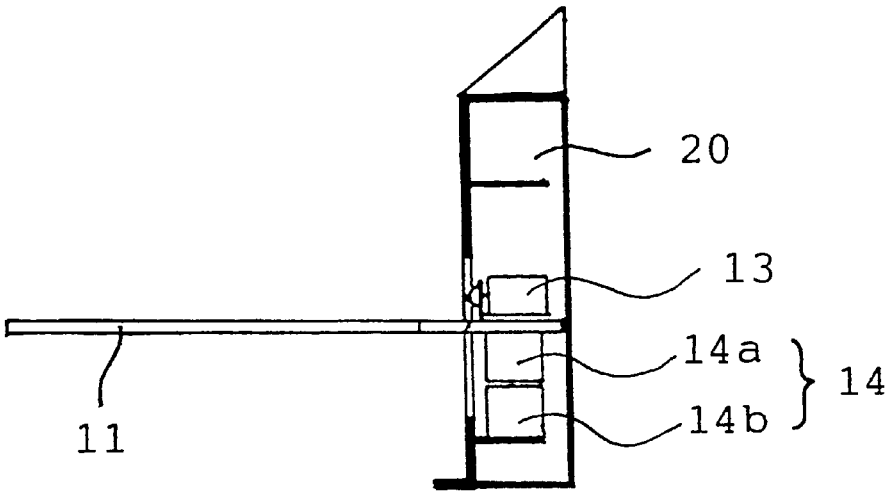
FIG. 1*a* shows a side cross-sectional view of one embodiment of a delivery signal device according to the invention.
Figure 1B:
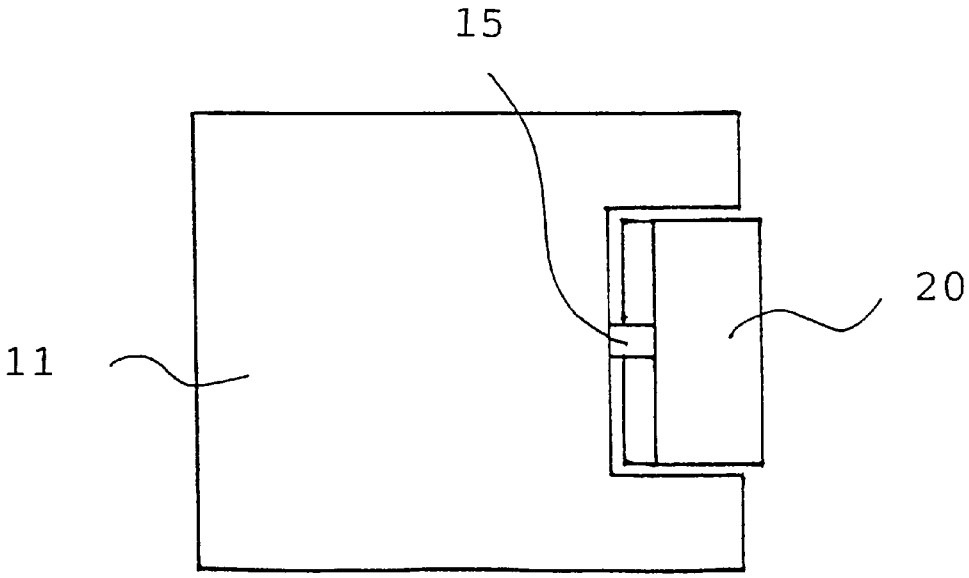
FIG. 1*b* shows the plan view of the delivery signal device shown in FIG. 1*a*.
Figure 1C:
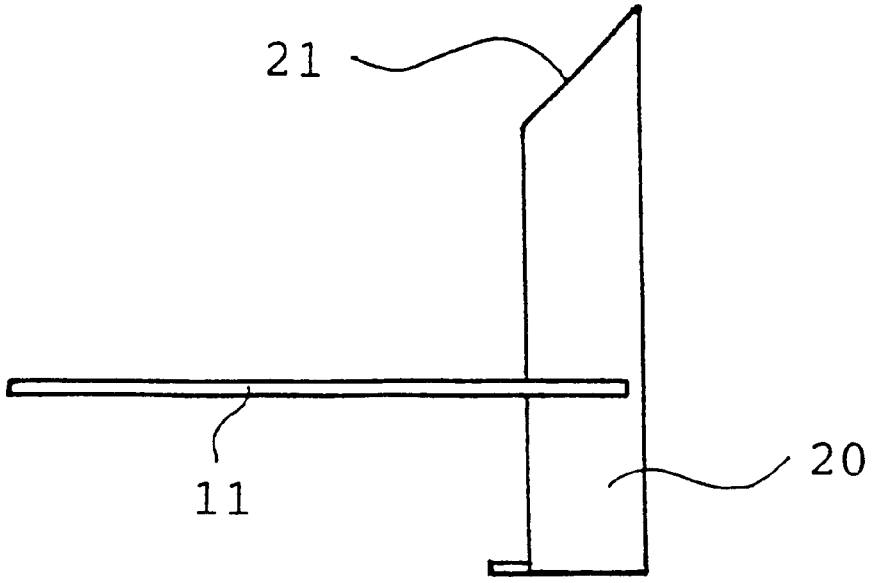
FIG. 1*c* shows the side view of the delivery signal device shown in FIG. 1*a*.
Figure 1D:
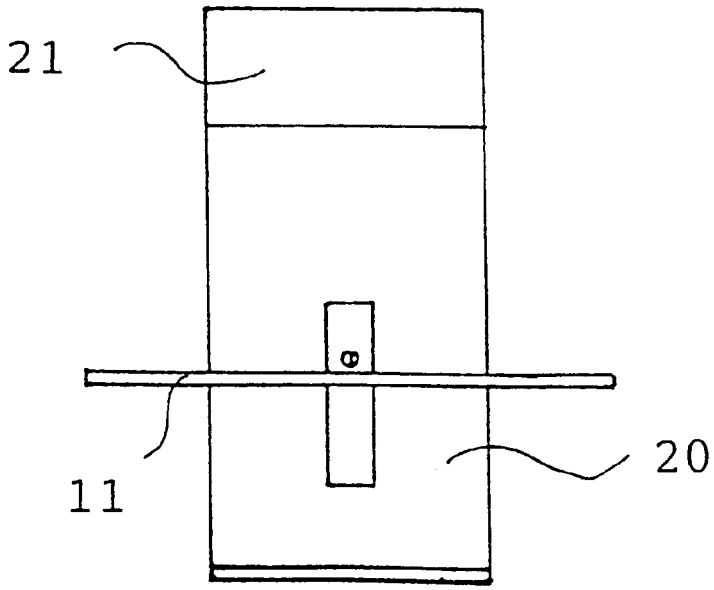
FIG. 1*d* shows the front view of the delivery signal device shown in FIG. 1*a*.

For the ease of explanation, like components in the invention are referred to using like numerals. However where there is a need to differentiate like components, a suffix 'a' or 'b' is used after the numeral.

Referring to FIGS. 1*a*, 1*b*, 1*c* and 1*d*, one embodiment of the invention is illustrated by its side cross-sectional view, its plan view, its side view, and its front view. The delivery signal device is intended to be fitted to the inside of a mailbox. A container (20) is employed to house a counter weight (13), a magnetic switch (14), a battery (191) and an electrical circuit (19). A catcher means (11) is provided and protrudes from the middle of the container (20). The size of the catcher means (11) is configured, so as to cover a substantial portion of the base area of the mailbox.

Figure 2:
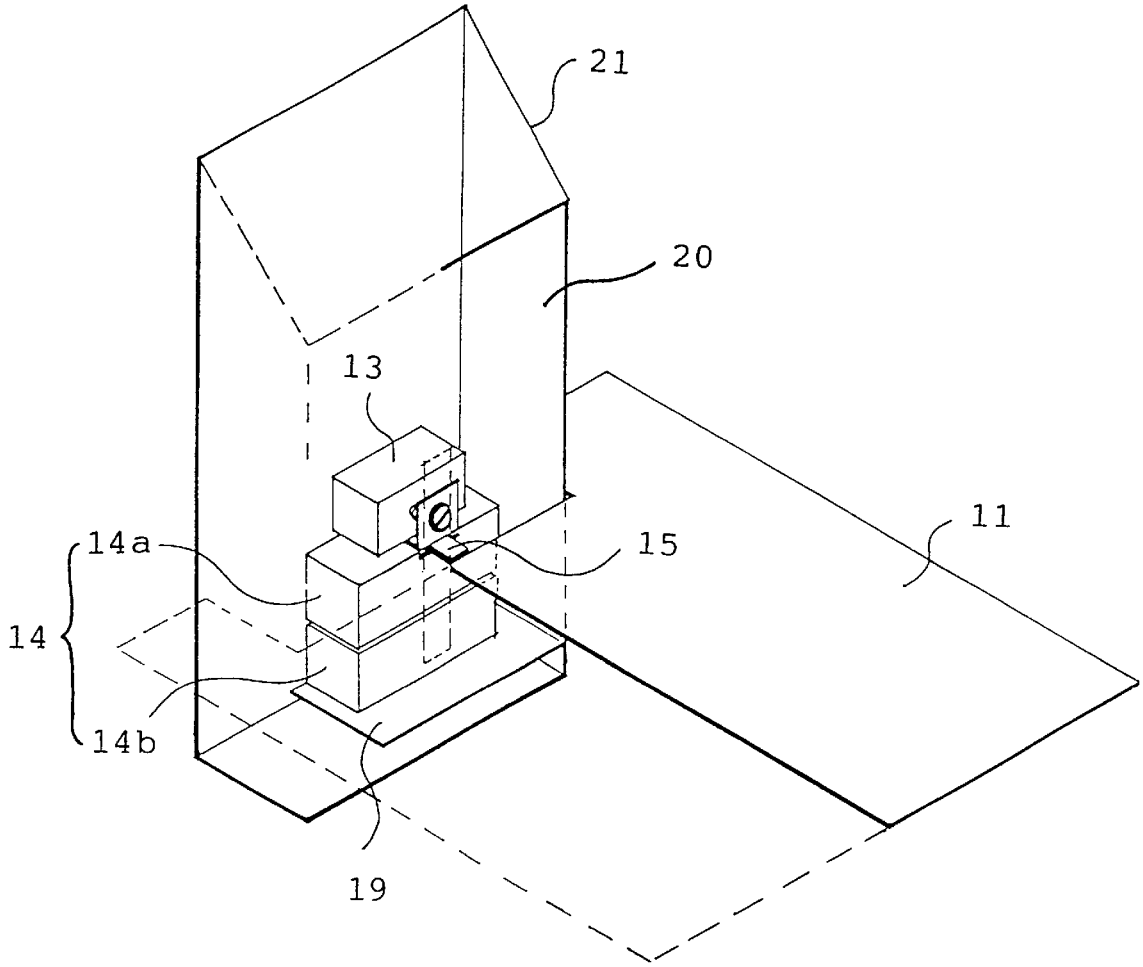
FIG. 2 shows in perspective the front side of the delivery signal device shown in FIG. 1*a*, exposing the various components making up the device.

FIG. 2 shown in perspective the front side of the delivery signal device, exposing the various components making up the device. The figure shows the invention at the state of equilibrium where there is no mail in the mailbox. The catcher means (11) is then horizontal. The (partially shown) catcher means (11) is connected to the effort arm of a lever (15) outside the container (20). The counter weight (13) is mounted onto the load arm of the lever (15) inside the container (20). The magnetic switch (14) consists of two components:- one is a magnet means (14*a*) and one is a reed switch (14*b*) which are both provided inside the container (20). The magnet means (14*a*) is mounted to the underside of the load arm of the lever (15) and is disposed above the reed switch (14*b*) which is mounted on an integrated electrical circuit (19) block. This magnetic switch (14) further operates the battery-driven electrical circuit (19) to activate a warning system. The electrical circuit (19) block is disposed at the base of the container (20). It can be noted that the top of the container (20) has a reclining roof (21), with the lower edge disposed towards the catcher means (11). The top edge of the roof is normally disposed under the slot (not shown) provided in the mailbox. The lower edge of the roof is sloping towards the catcher means (11). This reclining roof (21) allows and guides any mail to slide towards the catcher means (11).

The entire delivery signal device is mounted inside the mailbox. The electrical circuit (19) is activated by the magnetic switch (14) whenever the catcher means (11) receives a mail. The electrical circuit (19) is de-activated whenever the mail is removed or the mailbox is empty.

Figure 3A:
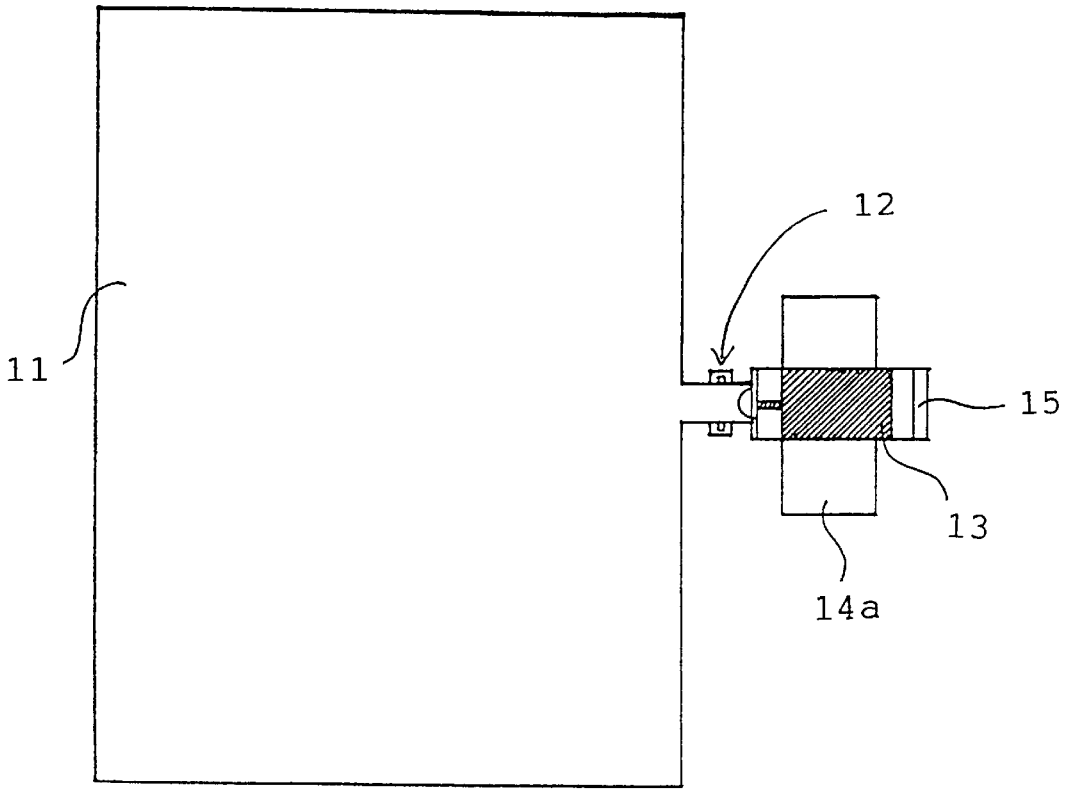
FIG. 3*a* shows the plan view of a lever of the delivery signal device shown in FIG. 1*a*.
Figure 3B:
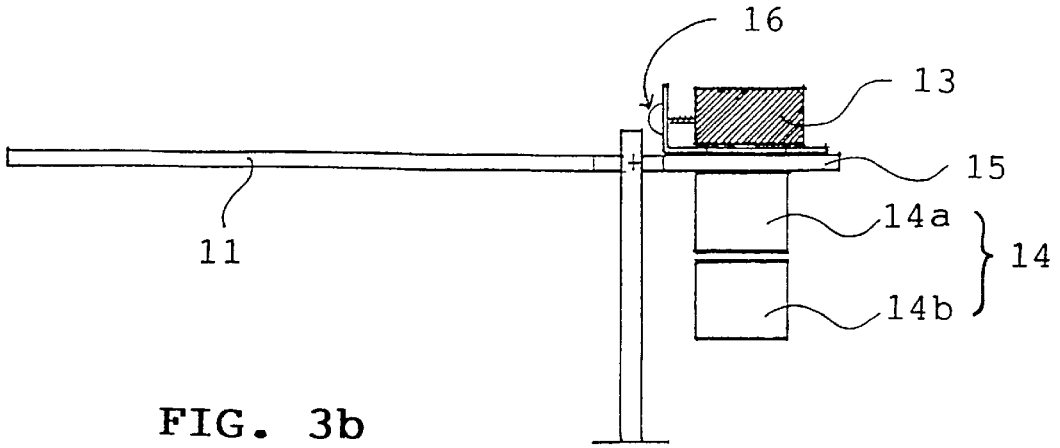
FIG. 3*b* shows the side view of the lever shown in FIG. 3*a*, when it is not receiving any mail.
Figure 3C:
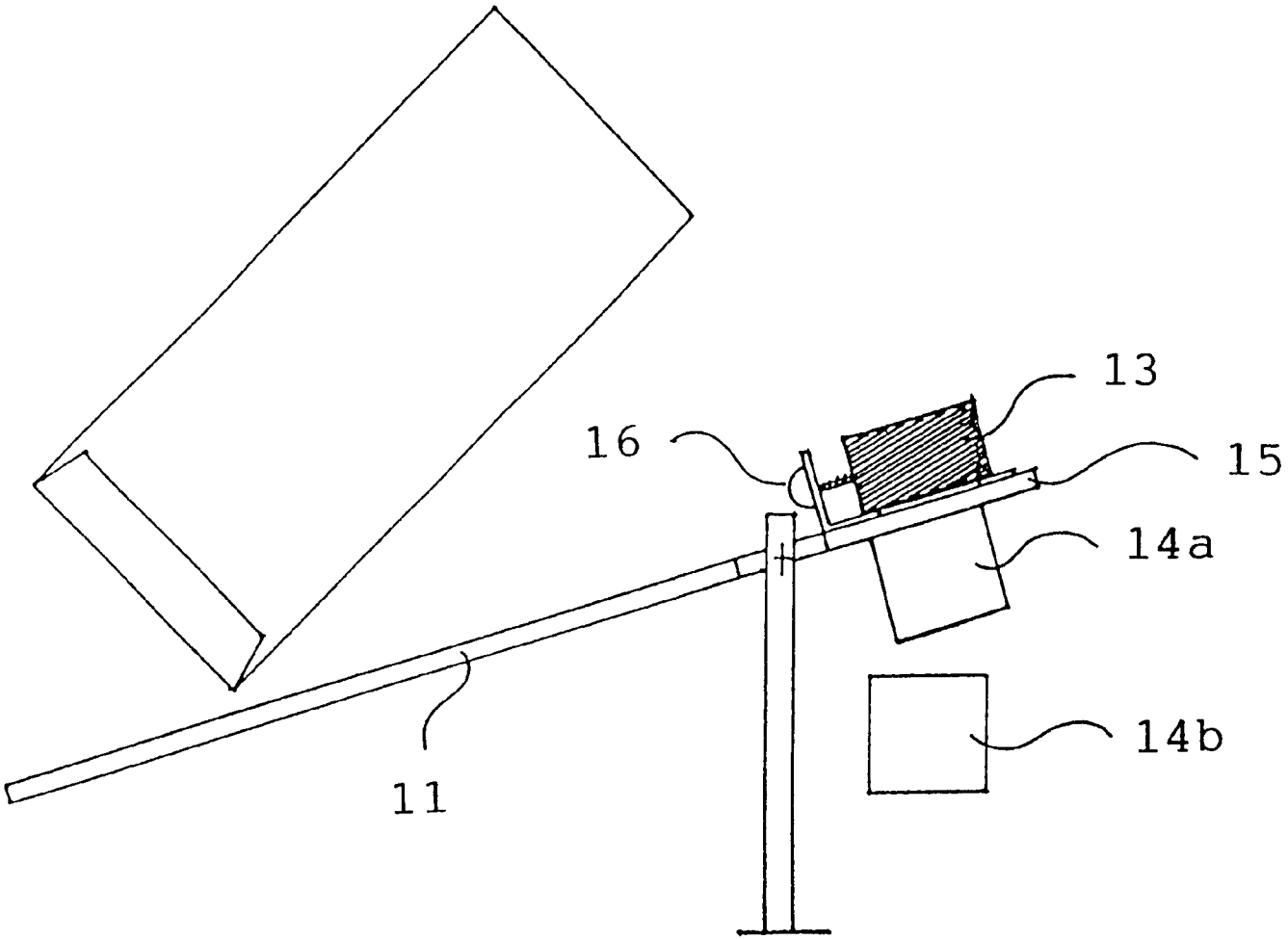
FIG. 3*c* shows the side view of the lever shown in FIG. 3*b*, when it receives a mail.

FIGS. 3*a*, 3*b* and 3*c* illustrate how the lever (15) will be working. No other components are shown. The lever (15) consists essentially of an elongated arm, with a hinge or a pivot (12) in its middle portion, dividing the arm into an effort arm and a load arm. The catcher means (11) takes the shape of a flat member, which is connected to the effort arm of the lever (15). In FIGS. 3*a* and 3*b* the lever (15) is at the state of equilibrium, representing a state where there is no mail in the mailbox. The counter weight (13) on the load arm counter-balances the catcher means (11) on the effort arm. The counter weight (13) is mounted according to a preferred way which will be explained later. Under the counter weight (13), a magnetic switch (14) is provided. The magnetic switch (14) consists of two components:- one is a magnet means (14*a*) which is mounted to the underside of the load arm of the lever (15), and one is a reed switch (14*b*) which is mounted on an integrated electrical circuit (19) block. When there is no mail in the mailbox, the lever (15) is then horizontal, and the magnetic switch (14) is electrically off with the magnet means (14*a*) being placed over the normally closed reed switch (14*b*). When there is a mail in the box, the weight of the mail will tilt the catcher means (11) downwards. The magnetic switch (14) is electrically on when the magnet means (14*a*) being tilted away from the reed switch (14*b*).

Figure 4:
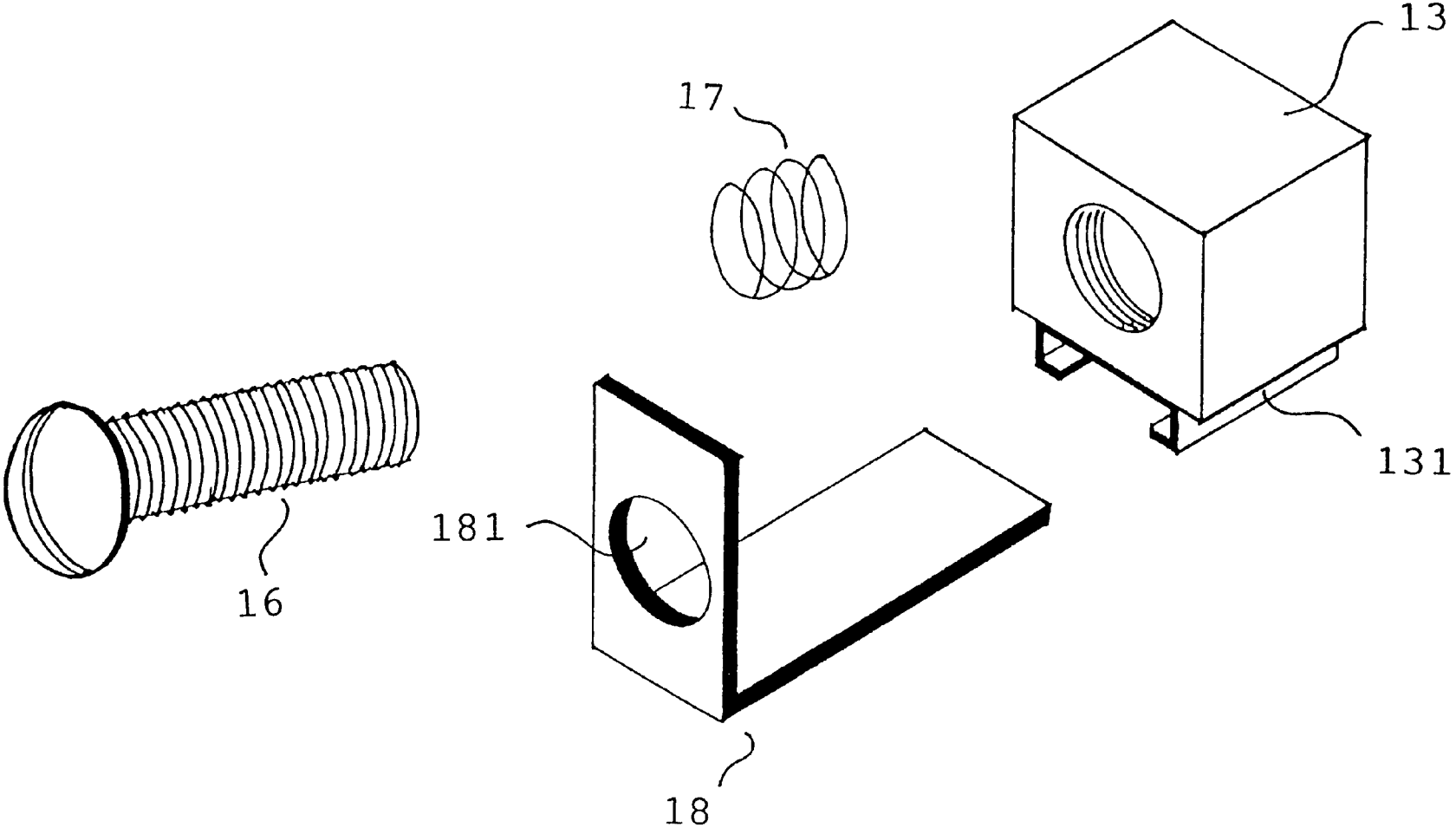
FIG. 4 shows in perspective a counter-balance arrangement in the lever shown in FIG. 3*a*.

FIG. 4 illustrates a way of mounting the counter weight (13) onto the load arm of the lever (15). In this mechanism, the counter weight (13) normally takes the shape of a square block, with a threaded hole provided at its side. Under this counter weight (13), there is provided an U-channel (131) which receives a L-shaped linkage means (18). The upright portion of the linkage means (18) is provided with an opening (181) which corresponds to the side opening in the counter weight (13). A screw (16) is used to pass through this opening (181) and engages the side opening in the counter weight (13). A spring (17) is provided between the upright portion and the counter weight (13) to provide the necessary urging action. By turning the screw (16), the counter weight (13) is shifted in its position along the U-channel (131), thereby adjusting the position of the gravity. This mechanism provides a balancing means to achieve equilibrium with the catcher means (11). When the size of the catcher means (11) is adjusted to match that of the mailbox, the weight of the counter weight (13) has to be adjusted accordingly.

Figure 5:
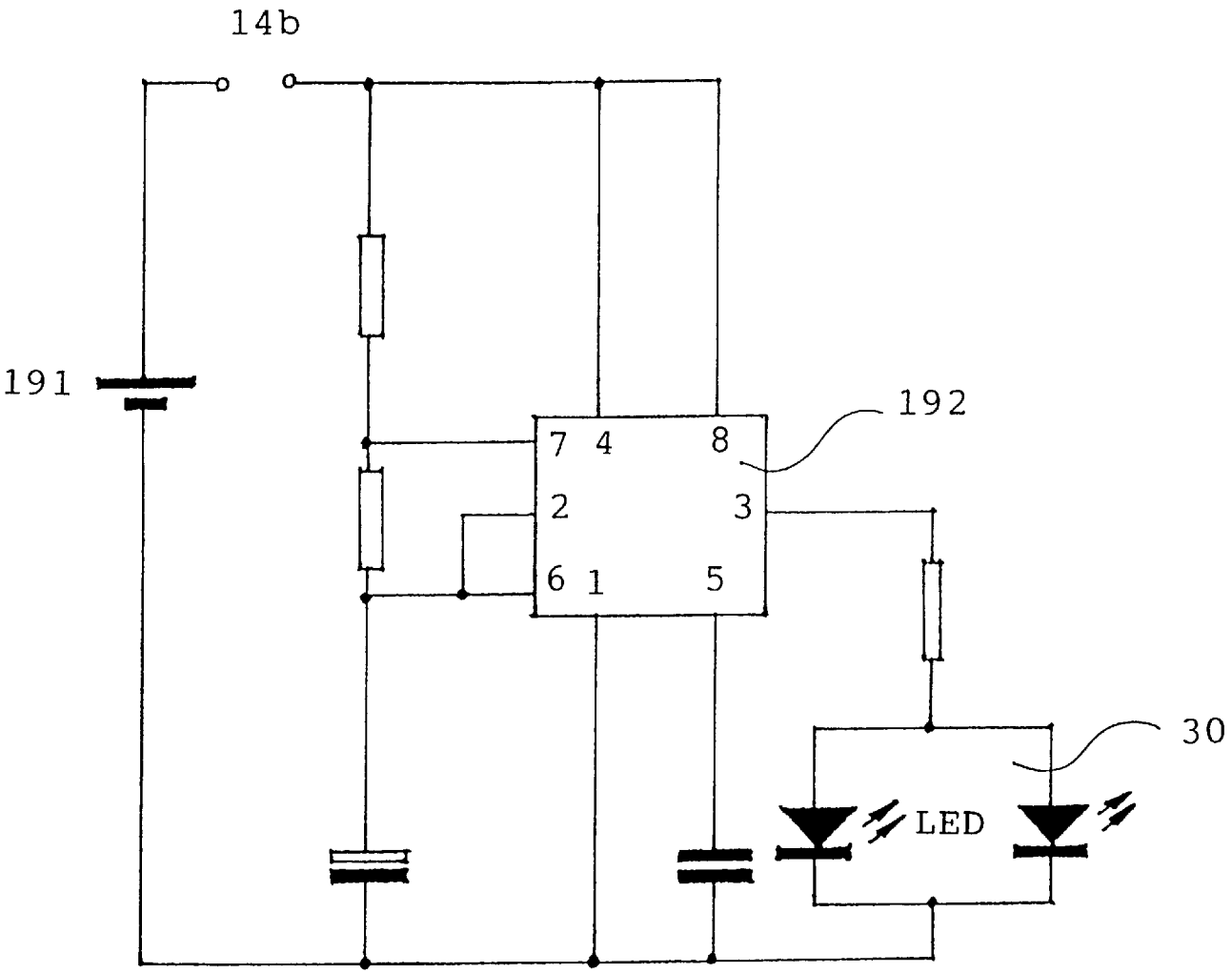
FIG. 5 shows one example of an electrical circuit to actuate a flashing lighting arrangement for the delivery signal device according to the invention.

The magnetic switch (14) is employed to activate a warning signal according to the invention. The signal can be audio or visual or a combination of the two. FIG. 5 shows one example of an electrical circuit (19) to actuate a flashing lighting arrangement for the delivery signal device according to the invention. LED is preferably used, since it consumes little electricity. The electrical circuit (19) is battery-driven (9 volt). An integrated NE555 multi-vibrator circuit (192) is the key component in this electrical circuit (19) as illustrated. The LED will be flashing. Alternatively where a steadily illuminated warning signal is desirable, the multi-vibrator circuit (192) can be ommitted.

Figure 6A:
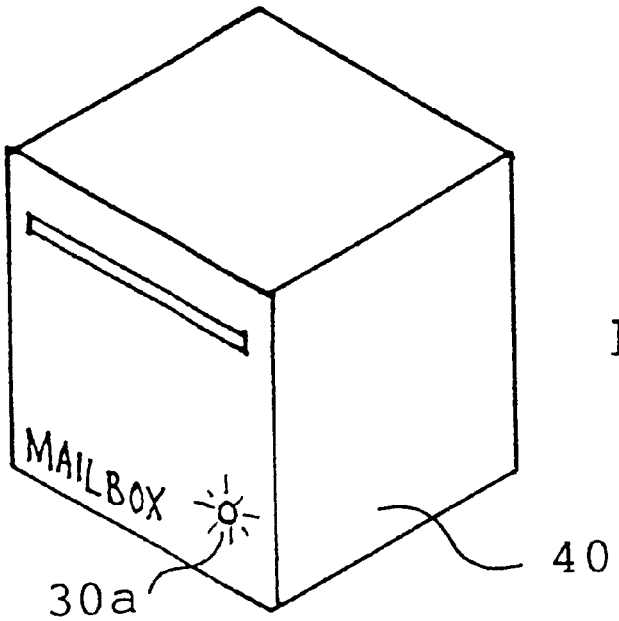
FIG. 6*a* shows the lighting output of the delivery signal device resident on a mailbox.
Figure 6B:
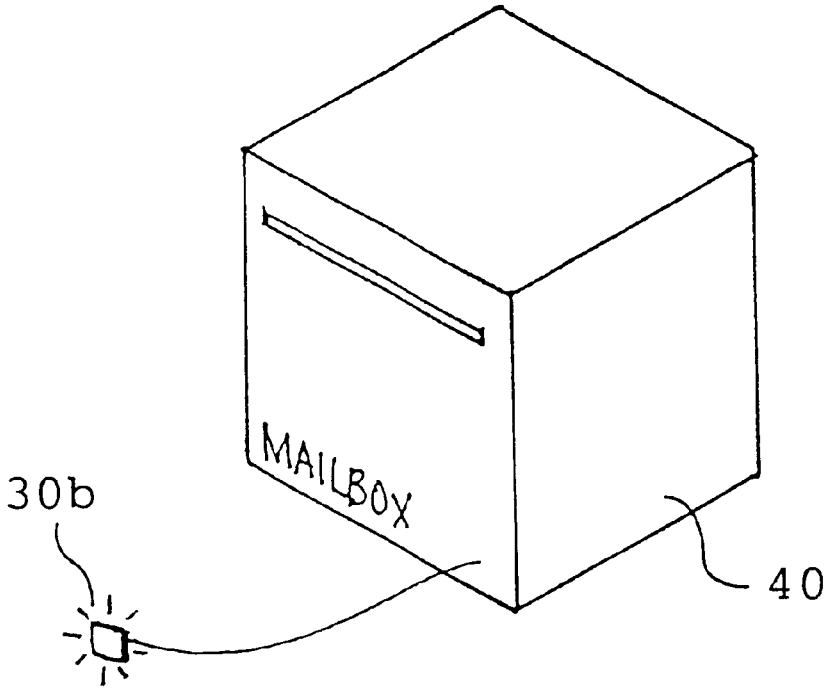
FIG. 6*b* shows the lighting output of the delivery signal device in extendible wiring to a remote location.
Figure 6C:
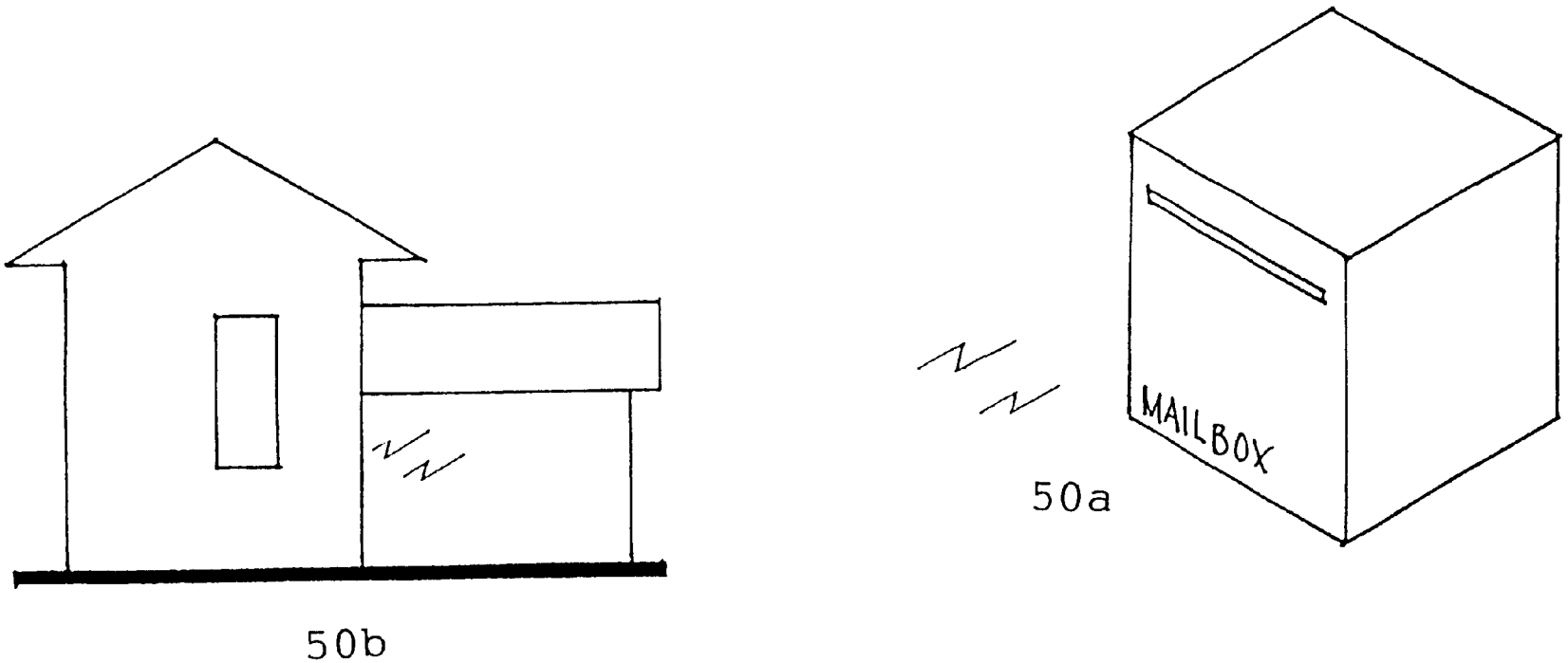
FIG. 6*c* shows the audio output of the delivery signal device from a mailbox to a receiver unit in a remote location such as a house.

In the case of visual warning signal from the electrical circuit (19), the light (30*a*) can be resident on the mailbox (40) as in FIG. 6*a*, or extended as in FIG. 6*b*. In the extended case, the light (30*b*) can be placed at a location remote from the mailbox (40), as in rural or urban settings. In the case of an audio warning signal from the electrical circuit (19), the magnetic switch (14) can activate a radio frequency (RF) signal transmitter (50*a*) at the mailbox, and the RF signal can be received by a RF receiver (50*b*) at a remote location as in FIG. 6*c*.

Figure 6D:
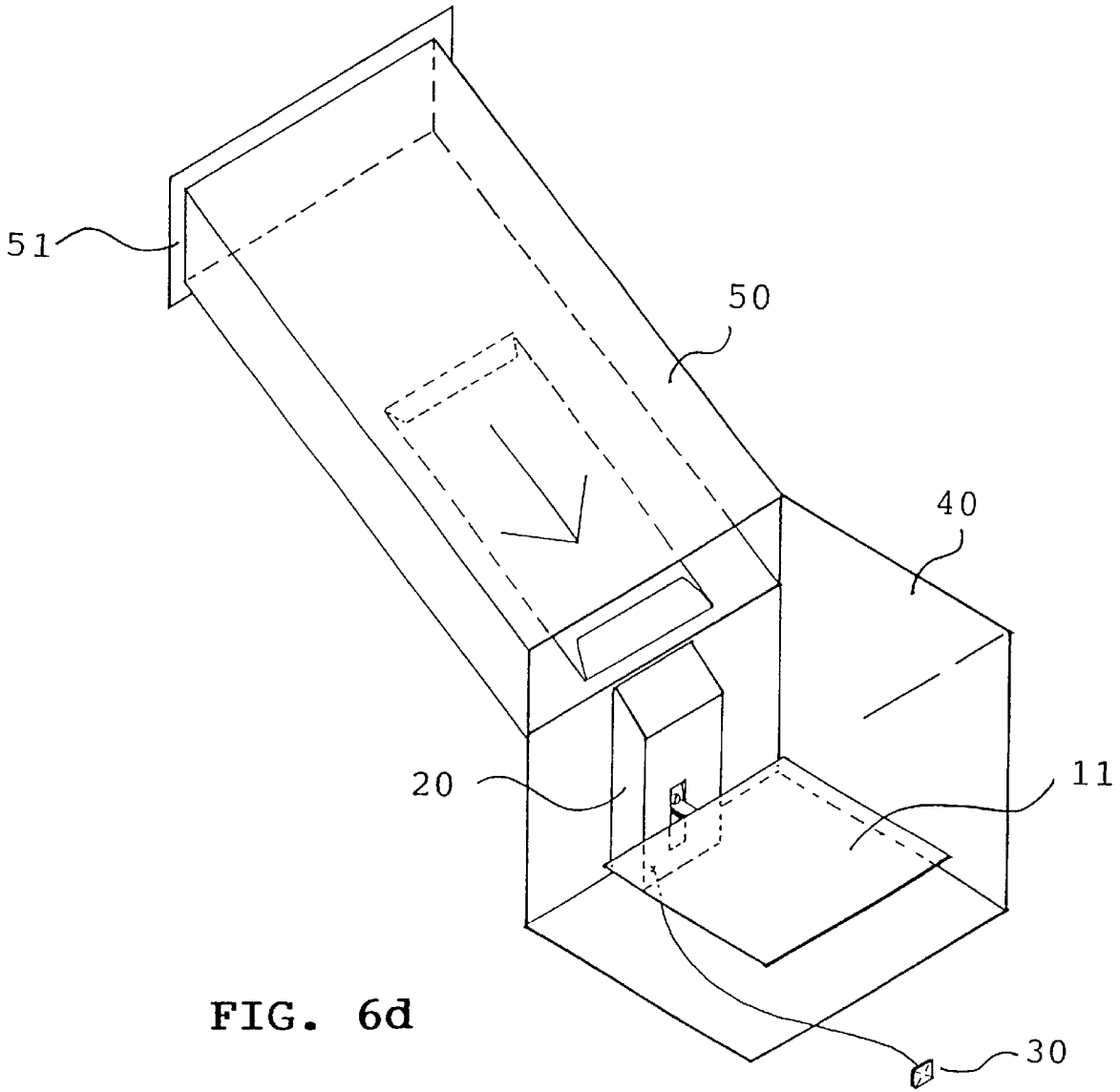
FIG. 6*d* shows a section view of the delivery signal device according to the invention installed to a pillar mounted type mailbox.

The intention is not restricted to the embodiments illustrated and described above. Modifications and alterations of the detail can be made within the scope of the invention defined in the appended claims. FIG. 6*d* shows a section view of the delivery signal device according to the invention installed to a pillar mounted type mailbox (40). In this case, a modified mailbox (40) equipped with the invention is placed under an intermediate conduit (50) which communicates a mail insertion slot (51) with the mailbox (40).

What is claimed is:

1. A delivery signal device for a mailbox, comprising a catcher means (11), connectable to a magnetic switch (14); the magnetic switch, connectable to a warning system; and a container (20) to house all components of the device except the catcher means (11), is characterized in which the delivery signal device is mounted inside the mailbox;

the catcher means (11) is connected to the effort arm of a lever (15);

a counter weight (13) is mounted onto the load arm of the lever (15);

the magnetic switch (14) consists of a magnet means (14*a*) mounted to the underside of the load arm of the lever (15) and a reed switch (14*b*) mounted on an integrated electrical circuit (19) block;

the magnetic switch (14) further operating the electrical circuit (19) to activate the warning system;

whereas the electrical circuit (19) is activated by the magnetic switch (14) whenever the catcher means (11) receives a mail, and the circuit (19) is de-activated whenever the mail is removed or the mailbox is empty.

2. A delivery signal device for a mailbox as in claim 1 in which the magnetic switch (14) is electrically off with the magnet means **(14*a*) being placed over the normally closed reed switch (14*b*), when the lever (15) is in a state of equilibrium with no mail in the mailbox; whereas the magnetic switch (14) is electrically on with the magnet means (14*a*) being tilted away from the reed switch (14*b*), when the lever (15)** is off-balanced by the presence of a mail.

3. A delivery signal device for a mailbox as in claim 2 in which the catcher means (11) is fitted to the outside of the container (20) and is employed to engage the effort arm of the lever (15).

4. A delivery signal device for a mailbox as in claim 3 in which the size of the catcher means (11) can be adjusted to fit the size of the mailbox, and is normally in the shape of a flat member.

5. A delivery signal device for a mailbox as in claim 2 in which the catcher means (11) connected to the effort arm of the lever (15), and a counter weight (13) adjustably placed onto the load arm form a lever (15) mechanism pivoted in the middle.

6. A delivery signal device for a mailbox as in claim 1 in which the warning system includes an audio signal, a visual signal or a combination of the two.

7. A delivery signal device for a mailbox as in claim 6 in which the visual signal can be resident on the mailbox.

8. A delivery signal device for a mailbox as in claim 6 in which the visual signal can be extended and provided remote from the mailbox.

9. A delivery signal device for a mailbox as in claim 6 in which the visual signal is either flashing or steadily illuminated.

10. A delivery signal device for a mailbox as in claim 6 in which the electrical circuit (19) is battery-driven.

* * * * *